United States Patent [19]

Banks

[11] Patent Number: 4,758,502

[45] Date of Patent: Jul. 19, 1988

[54] PHOTOGRAPHIC CONTRAST MASKING WITH A PHOTOCHROMIC BODY

[75] Inventor: Paul Banks, Altrincham, Great Britain

[73] Assignee: Image Master Limited, England

[21] Appl. No.: 795,348

[22] PCT Filed: Feb. 28, 1985

[86] PCT No.: PCT/GB85/00079

§ 371 Date: Oct. 29, 1985

§ 102(e) Date: Oct. 29, 1985

[87] PCT Pub. No.: WO85/04027

PCT Pub. Date: Sep. 12, 1985

[30] Foreign Application Priority Data

Feb. 29, 1984 [GB] United Kingdom ..... 8405295

[51] Int. Cl.[4] ..... G03C 5/00

[52] U.S. Cl. ..... 430/394; 430/332; 430/333; 430/396; 430/962

[58] Field of Search ..... 430/5, 6, 7, 394, 396, 430/397, 292, 962, 293, 332, 333

[56] References Cited

U.S. PATENT DOCUMENTS

| | | | |
|---|---|---|---|
| 2,203,652 | 1/1939 | Ehrenfried . | |
| 3,105,761 | 9/1958 | Foris . | |
| 3,160,504 | 12/1964 | Montani . | |
| 3,442,648 | 5/1969 | Smith . | |
| 3,510,305 | 5/1970 | Craig et al. | 430/394 X |
| 3,973,966 | 8/1976 | Flannery et al. | 430/332 |
| 4,321,321 | 3/1982 | Moore | 430/356 |

FOREIGN PATENT DOCUMENTS

| | | |
|---|---|---|
| 935644 | 11/1955 | Fed. Rep. of Germany . |
| 8011606 | 4/1980 | Fed. Rep. of Germany . |
| 3221349 | 12/1983 | Fed. Rep. of Germany . |
| 1521547 | 3/1967 | France . |
| 1186772 | 5/1967 | United Kingdom . |

OTHER PUBLICATIONS

D. A. Spencer, *The Focal Dictionary of Photographic Technologies*, 1973, p. 443.

*Primary Examiner*—John E. Kittle
*Assistant Examiner*—José G. Dees
*Attorney, Agent, or Firm*—Lerner, David, Littenberg, Krumholz & Mentlik

[57] ABSTRACT

A contrast mask for a transparent photographic original may be formed by illuminating a photochromic body (11,41) through the original with white light. Preferably the photochromic body (11,41) is optically neutral (grey) and contains a silver halide as a photochromically active substance. Preferably the mask-forming exposure is performed separately from the photographic exposure of a recording medium through the original and the mask, by a different light source (27). The optical contrast range of the mask can be varied in response to the optical contrast range of the original by varying the amount of the mask-forming exposure. This variation is preferably effected by varying the number of flashes of the light source (27).

The photochromic body is preferably incorporated in the holder (1,33) for the transparent original.

Photographic reproduction apparatus may include an automatic densitometer, the output of which controls the amount of the mask-forming exposure.

17 Claims, 3 Drawing Sheets

PHOTOGRAPHIC CONTRAST MASKING WITH A PHOTOCHROMIC BODY

TECHNICAL FIELD

The present invention relates to contrast masking in photographic processes. In many photographic processes an original, usually transparent, is illuminated, and an image is thrown on a photosensitive material to create a reproduction of the original. In many cases the range in optical density between the lightest point and the darkest point of the original (or in practice between the lightest point and the darkest point which retain detail, rather than between any totally white or black areas), known as the contrast range of the original, is too great to provide the optimum appearance of the reproduction. This is especially, but not exclusively, the case when a transparent original is being used to make a reproduction intended to be viewed by reflected light. If the contrast range is too great, then either the dark parts of the reproduction are too dark for detail to be seen clearly or the light parts are so light that detail is "washed out".

In other photographic processes the original may not be transparent, for instance it may be a print, or a scene which is being photographed.

If the contrast range in the original is too great for an optimum reproduction, the photographic craftsman has several ways of compensating for this. He may "dodge" or "burn in" selected areas of the reproduction by hand (darken or lighten the areas by selective covering and exposing). However, this is difficult and time-consuming, and requires considerable skill to do well. An alternative method is to form a contrast mask. A contrast mask is a negative image of the original, and as such its greatest optical density is in those areas where the original has its least optical density, and vice versa. If the contrast mask and the original are placed together in perfect alignment, the composite will retain the detail of the original perfectly, while having a contrast range which is less than that of the original. By controlling the exposure during formation of the mask its optical density range can be controlled, and thus the contrast range of the composite can be controlled to provide any desired preselected value. Typically the composite of contrast mask plus original may have a contrast range of 2.4, compared with a range of perhaps 2.8 for the original alone.

To form a contrast mask, the original is placed in contact with a piece of unexposed monochrome negative film, registration holes or the like may be punched through them, and then they are exposed to the amount of light required to form a mask of the desired density range. The monochrome film is then separated from the original and developed to form the contrast mask. Finally the contrast mask and the original are placed back together again and aligned by means of the registration holes or the like or registered by eye, and the composite thus formed is used to create the reproduction in the normal way.

This process of contrast masking is tedious and time-consuming. Additionally it may be difficult to replace the mask in perfect register with the original, and the mask may shrink a little during developing making perfect alignment over the whole area of the original impossible. Finally, any defects in the mask, eg. resulting from dirt, add to the defects which will appear in the reproduction. In spite of these drawbacks, the process of contrast masking is very widely used, as the effect on the quality of a reproduction of contrast range reduction is considered highly desirable in high quality photographic applications.

BACKGROUND ART

In the 1950's a proposal was made by Dwin R Craig and John N Street that a photographic contrast mask should be made using a metachromatic oil use. This material had a photochromic property, in that exposure of it to blue light caused it to turn a brillant blue, and exposure to yellow light turned the blue material colourless. Craig and Street proposed that a body should be made bearing a film of this oil or a layer of microencapsulated such oil. The body was to be aligned with a transparency and then illuminated with blue light shone through the transparency. A blue contrast mask would then be formed instantly by the photochromic effect. The photochromic reaction of the metachromic oil dye is extremely fast, and Craig and Street propose that the photographic exposure in the reproduction process and the mask-forming exposure are carried out simultaneously, the photochromic body acting in effect as a shutter the speed of which varies with the optical density of the transparency. A US patent application for this proposal was filed in 1958, an equivalent UK patent specification was published in 1962 as No. 891992 and a US patent issued in 1970 as No. 3510305.

For practical purposes, the Craig and Street proposal appears to be useless. It is a feature of their system that the light used in the photographic exposure is of a wavelength to which the photochromatic oil dye is not reactive. Indeed, it is clear that if yellow light was used for the photographic exposure, it would clear the dye, wiping out the contrast mask. It appears that blue light, while tending to form the masking image, is not absorbed by it, since the image is a brilliant blue which implies that blue light is transmitted through it. This will also make blue light unsuitable for use in the photographic exposure. As a result, any attempt to use the body with metachromatic oil dye as a contrast mask in colour reproduction, will dramatically alter the colours in the reproduction and in addition relatively dark areas which are coloured blue will tend to be masked more densely than relatively pale areas coloured yellow, owing to the colour sensitivity of the metachromatic oil dye, so that the contrast masking effect provided will be wholly incorrect. While it may appear that the process might be of some value in monochrome photographic reproduction, the modern practice of using multigrade paper prevents this, as is explained below.

Different grades of photosensitive paper respond to illumination in different ways, so that to print onto one grade of paper will produce a high contrast print and to print onto another will produce a low contrast print. A photographic craftsman would have to stock paper of all different grades and select the appropriate one for any given printing operation. However, multigrade monochrome paper is so designed that it reacts differently to different wavelengths of light, so that the apparent grade of the paper is determined by the colour of the light used in the photographic exposure. Unfortunately for the Craig and Street proposal, the colours used to control the grade behaviour of modern multigrade paper are blue and yellow, pure light of one colour giving the highest contrast image and pure light of the other colour giving the lowest contrast image.

The patent referred to above acknowledges that the particular matachromic oil dye used is not suitable for colour photography, and propose "Suitable mixtures of photochromic bodies or dyes can be employed to produce spectral changes from a clear phase to a neutral gray transmission, and modified by exposure to obscuring light and clearing light having wavelengths beyond the visible range." However, it appears that many years of research were spent in attempting to develop such a material, first at the National Cash Register Company and then at British American Tobacco Ltd, but eventually this research was abandoned without a suitable material having been found.

In FIG. 8 of the patents referred to above, a rough graph is given of the transmission of radiation through the photochromic body against the wavelength of the radiation. In the description of this Figure it is stated that the spectral transmission of the photochromic body should be substantially neutral in both the obscured and cleared phases throughout the "actinic range" ("actinic range" is apparently used in the patents to refer to wavelengths used in the photographic process). The Figure does show a relatively flat transmission characteristic in the range between the clearing and obscuring wavelengths. However, the Figure also shows greater transmission in the clearing and obscuring wavelengths than in the intermediate wavelengths when the material is "cleared" as well as when it is "obscured". Thus the Figure cannot be presenting factual data about the known metachromic oil dyes disclosed in the patents, since these are said to be colourless when clear. To be colourless when clear requires that the transmission of the obscuring blue light and the clearing yellow light are both equal to the transmission of intermediate wavelengths when the material is clear, in contradiction to the Figure. Thus it appears that this Figure in the patents represents wishful thinking and a statement of desiderata rather than a description of any substance known to Craig and Street.

The effect of the Craig and Street proposal appears to have been to divert attention into an unprofitable area, and thus inhibit the creation of a usable method of contrast masking by use of photochromic material.

DISCLOSURE OF THE INVENTION

According to a preferred embodiment of the present invention there is provided a method of contrast masking in a process of photographic reproduction of an original, the contrast mask being formed by exposure of a photochromic body to electromagnetic radiation and the process including a photographic exposure in which the said original is illuminated by electromagnetic radiation so as to affect a recording medium, in which process:

- the wavelengths of radiation used to form the contrast mask comprise wavelengths used to affect the recording medium in the photographic exposure;
- the photochromic body is sensitive, so as to increase its optical density, to the majority of wavelengths in the visible spectrum but substantially none of the wavelengths of the visible spectrum to decrease its optical density; and
- the photochromic body, when its optical density has been increased by exposure to electromagnetic radiation, has an increased optical density with respect to substantially all wavelengths in the visible spectrum.

As mentioned above, the original may be, but is not necessarily, transparent. Also, the reproduction may be transparent or not. For example, the reproduction process may be transparency duplication, printing, or photographing a scene or an object. If the original is viewed by reflected light, the contrast mask cannot be formed by placing the photochromic body immediately in front of the original, but satisfactory contrast masking can still be obtained if the photochromic body is placed at a part of the light path where the image is focussed. This will normally mean placing the photochromic body immediately in front of the location of the photosensitive recording medium. In a camera, the body could be located adjacent the film plane. The photochromic body can, of course, be located in such position even if the original is viewed by transmitted light.

According to another preferred embodiment of the present invention there is provided a holder for a transparent original in a photographic reproduction process, characterised in that it comprises a photochromic body which is sensitive, so as to increase its optical density, to the majority of wavelengths in the visible spectrum, but substantially none of the wavelengths in the visible spectrum tend to decease its optical density, and which, when its optical density has been increased by exposure to electromagnetic radiation, has an increased optical density with respect to substantially all wavelengths in the visible spectrum, whereby if the transparent original is placed in face-to-face relationship with the photochromic body the body may be exposed to electromagnetic radiation through the original so as to form a contrast mask for the original in the said body.

Preferably the optical density of the photochromic body returns substantially to its minimum value in 30 seconds or less if the body is held at a temperature of 27° C.

Preferably the photochromic body when it increases in optical density due to exposure to electromagnetic radiation, increases in optical density to the same amount with respect to all wavelengths in the visible spectrum. More preferably the photochromic body is an optically neutral grey.

In another embodiment of the present invention there is also provided a method of preparing photographic reproductions, such as reflection originals for printing, in which respective portions of a photosensitive recording medium are successively exposed to respective photographic originals, usually transparent, in a succession of respective photographic reproduction processes during which the remaining said portions of the recording medium are protected from exposure, each said photographic reproduction process including contrast masking by a method in which a photochromic body is illuminated by an image of a photographic original body. Preferably the contrast masking is performed by a method as described above.

In yet another embodiment of the present invention there is further provided a photographic reproduction apparatus having a first enclosure and a first light source mounted in the first enclosure, whereby a photosensitive recording medium may be exposed to light through a transparent original, characterised in that mounted in the second enclosure, the second light source being a white light source, whereby a photochromic body may be exposed to white light through a transparent original so as to form a contrast mask for the transparent original which may be used during the said exposure of the photosensitive recording medium.

In yet another embodiment, the present invention provides photographic reproduction apparatus having means for supporting a photosensitive recording medium in an image plane, characterised in that it has a photochromic body located immediately in front of the image plane.

In a further embodiment, the present invention provides a method of preparing photographic reproductions, in which respective portions of a photosensitive recording medium are successively exposed to respective transparent photographic originals in a succession of respective photographic reproduction processes during which the remaining said portions of the recording medium are protected from exposure, each said photographic reproduction process including contrast masking by a method in which a photochromic body is illuminated by an image of the original.

In yet a further embodiment, the present invention provides a method of contrast masking in a process of photographic reproduction of an original, the contrast mask being formed by the exposure of a photochromic body to electromagnetic radiation bearing an image of the original and the process including a photographic exposure in which the said original is illuminated by electromagnetic radiation so as to affect a recording medium;

characterised in that the photochromic body is exposed to form the contrast mask in a plurality of flashes.

In a still further embodiment, the present invention provides a method of contrast masking in a photographic reproduction process using a transparent original, the contrast mask being formed by the exposure of a photochromic body to electromagnetic radiation through the transparent original and the process including a photographic exposure in which the said transparent original is illuminated by electromagnetic radiation so as to affect a recording medium;

characterised in that the photochromic body is exposed to form the contrast mask at a first location and the photographic exposure takes place with the original and the photochromic body at a second location different from the first.

A large number of photochromic substances are known, and reference is made in this respect to the book "Photochemistry An Introduction" by D R Arnold, N C Baird, J R Bolton, J C D Brand, P W M Jacobs, P de Mayo, W R Ware, published in 1974 by the Academic Press, pages 238–261 where a number of these are discussed. In respect of any photochromic substance it will be a matter of trial and error to discover if it is suitable for use in the present invention, but the presently preferred photochromic bodies are formed from glass or other transparent materials containing one or more photochromic silver halide. Pages 258 to 261 of the book referred to above discuss the mechanism of silver halide photochomism, and state that the obscure phase is rendered obscure by the presence of metallic silver. This appears to cause the photochromic material to become dense to all visible wavelengths, which is one of the reasons for the suitability of this material for use in the present invention.

Silver halides have been well known as photochromic material for many years, and are widely used in photochromic sunglasses. A variety of uses for silver halides as photochromic materials are given on pages 264–267 of the book referred to above, but so far as is known it has never previously been proposed to use silver halides in a photochromic body for optical contrast masking.

The pages referred to above from the book "Photochemistry An Introduction" are hereby incorporated by reference, and copies of these pages are being filed with this application.

It appears that there are many different mechanisms of photochromism, and that not all of these are entirely understood. In some cases the photochromic materials are "cleared" by irradiation with particular wavelengths, while in other cases they are "cleared" by heat. So far as is known, there is no wavelength of radiation which acts to "clear" silver halides, but they are rapidly "cleared" by heating. Other materials which are "cleared" by certain wavelengths may be used in the present invention if they are otherwise suitable, provided that substantially no visible wavelengths have a clearing effect so as to avoid clearing of the contrast mask by the photographic exposure.

Preferably the mask-forming exposure and the photographic exposure take place at different locations. In this case it is preferred that the ambient temperature around the photochromic body throughout the said process up until it is moved to the location of the photographic exposure is no greater than 20° C., more preferably no greater than 19° C., and subsequent to the photographic exposure the contrast mask is cleared from the photochromic body (11,41) in a process during which the photochromic body is heated to at least 25° C., more preferably at least 26° C.

For most practical purposes the photochromic body should be optically neutral both when clear and when obscured, that is to say it should transmit all visible wavelengths substantially equally. It is not, however, necessary for the material ever to go totally clear, as any overall obscuring effect can be compensated for in the photographic exposure. Thus any colour cast which the body have in the clear phase can be corrected by incorporating appropriate materials, provided that the optical neutrality thus obtained is maintained as the body darkens. The behaviour of photochromic bodies containing silver halides is known to be affected by a number of parameters, most notably the heat treatment which the material receives during manufacturing. Chance Pilkington Ltd, the principal manufacturers in the UK of these materials, has made a number of suitable optically neutral photochromic bodies on request from the inventor. Materials identified as "Kiln Run 04 20-2", "Kiln Run 0400 23-2", "Kiln Run 20-2 STD" and "Kiln Run 1300 20-2" were found to be optically neutral to a sufficient degree.

In a preferred embodiment of the present invention there should be wavelengths (a) which act to darken the photochromic body, (b) which are reduced in intensity by the darkened photochromic body, and (c) which are used in the photographic exposure to affect the recording medium.

This is entirely contrary to the approach adopted in the Craig and Street proposal, but this requirement tends to ensure that the contrast mask is dense in the correct areas and affects the contrast range in the reproduction properly. A problem with the proposal in the Craig and Street patents for a neutral grey material, even if such a material had been developed, is that the mask is to be formed with invisible wavelengths not used in the photographic exposure. There is no guarantee that the transmission pattern of the transparency to ultraviolet or infra-red matches its pattern of transmission to visible wavelengths, and thus the mask formed might be inappropriate.

Although the photochromic body used in the process of the present invention should be darkened by exposure to the majority of wavelengths in the visible spectrum, it is not essential for practical purposes for it to be equally sensitive to all visible wavelengths. It is in the nature of the brightest parts of a photograph to be fairly white and for the darkest parts to be fairly black, so the contrast mask will form properly for these areas with little regard for the colour sensitivity of photochromic body. The colour range in its sensitivity is important only in the areas of medium optical density, where there should be an intermediate amount of darkening in the photochromic body for all colours.

Preferably the mask-forming exposure takes place before the photographic exposure. In this way, the contrast range of the original may be measured and the amount of mask-forming exposure required may be determined from this. In this case the photochromic body can be made relatively insensitive to light as compared with common photographic recording media. Thus the contrast mask is relatively unaffected by the photographic exposure. A small effect may be advantageous however, to preserve the mask and inhibit fading, especially as the photographic exposure may tend to heat the mask which will promote fading if silver halides are used. In such a case, the mask-forming exposure has to be correspondingly powerful, and this exposure may be performed as a series of flashes from a high intensity flash lamp. The number of flashes used is a control of the amount of the mask-forming exposure.

Preferably the mask-forming exposure is carried out with a multiple wavelength white light having a colour temperature of at least 4000K, more preferably at least 5000K. It is convenient to use for this purpose an adapted photographic studio flash lamp with a mirror giving a narrow beam and with a diffuser. Preferably the lamp is flashed at a rate of at least one flash per two seconds, more preferably at least one flash per second, and preferably each flash delivers at least 300 J of electromagnetic radiation, more preferably at least 400 J. The lamp may conveniently be flashed three times per second, delivering about 500 J per flash.

The parameters of the light used in the photographic exposure are very variable, and will depend on the photographic requirements in any particular instance. Colour filters, used to alter the colour balance in the reproduction or to match the sensitivity of the recording medium, will affect both the colour and the intensity of the light. Typically, a photographic enlarger may have a 2000 W incandescent bulb, and a suitable photochromic body might form only a very low contrast mask when exposed to the full light output of this bulb for 10 to 15 seconds (which is to subject the mask to much more light than it would normally receive during a photographic exposure).

As has been mentioned above, suitable photochromic bodies can be made by using silver halides as photochromic substances. Glasses and similar materials can be made incorporating silver halides which have the relative insensitivity to light discussed above (so that the mask is not greatly affected by the photographic exposure). They can also have good half tone reproduction so that the mask can have a range of optical densities in different areas. To be useful in practice the photochromic body must hold the contrast mask without more than limited fading for a period sufficient for the photographic exposure to take place. If the apparatus is set up in a convenient manner it may be possible for the photographic exposure to take place within a few seconds of the mask-forming exposure. However, it is preferable if a mask can be formed in the photochromic body which is still easily and clearly visible (though perhaps partially faded), several minutes after the mask-forming exposure. In the case of bodies incorporating silver halides, the speed of fading is heavily influenced by the temperature of the material.

With the samples of photochromic glasses referred to above, suitable behaviour can be achieved by maintaining the operating environment at about 65° F. (about 18° C.). This temperature represents a compromise between the performance of the glass, which performs better the lower the temperature and the comfort of the operator. Preferably in both the mask-forming exposure and the photographic exposure the light is passed through a filter to remove infra-red wavelengths, and this together with the lamp coating mechanisms of modern industrial photographic enlargers should hold the maximum temperature to which the photochromic body is exposed during the process to not greatly more than 70° F. (about 21° C.). The mask-forming exposure is preferably carried out not in the enlarger lamp housing but in a place which remains substantially at the temperature of the surrounding environment, so that the photochromic body is exposed to the higher temperatures for the minimum time. Since the mask-forming exposure may be performed by use of a flash lamp, which may produce "cold" light containing a relatively small proportion of infra-red, the infra-red filter may be used only during the photographic exposure. However, even these lamps normally produce a significant amount of infra-red and so the use of an infra-red filter during the mask-forming exposure is preferred.

In order to clear the mask from the photochromic body after the photographic exposure, it can be warmed to about 80° F. (about 26° to 27° C.), at which temperature the image will fade in a few seconds from the silver-halide-containing samples referred to above, and then cooled rapidly to the operating temperature of about 65° F. More preferably, the rapid cooling takes the photochromic body below 65° F., possibly down to about 45° F. (about 7° C.), and then it is allowed to warm up to the operating temperature. If a material is used for the photochromic body having good mask retaining behaviour at a temperature above 65° F., this may be more comfortable for the operator but it will have consequences for the ease with which the body can be cleared after the photographic exposure.

The apparatus which can be used to implement the present invention, and the details of the way in which that apparatus is used, can vary greatly. One application of the present invention is in the production of photographic reproductions by photo composition or montage of several originals, for use in printing, e.g. by a photogravure process. In this case it may be advantageous to use relatively sophisticated apparatus, such as one in which a number of transparent photographic originals may be loaded onto a carrier and be passed through a photographic exposure station. The mask-forming exposure may be performed by the same lamp as the photographic exposure or not, and it may take place at the same location or not. Preferably the photographic exposure and the mask-forming exposure are performed by different lamps in different enclosures, and the carrier takes each original first through a mask-forming station and then through a photographic exposure station.

The apparatus may be further automated by providing a station where the original is scanned and its contrast range determined automatically, and this information is used to determine the amount of exposure in the mask-forming step. Alternatively the contrast range may be determined by hand using a densitometer. Conveniently a "lookup table" may be prepared in exposure required for any given optical density range in the original. The table may be provided on a sheet of paper or in some other human readable form, and the operator may look up the required exposure and enter the information in a control means for the mask-forming exposure lamp. Alternatively the table may be stored in a memory of such a control means so that the operator merely enters the contrast range of the original or the densitometer readings. If the apparatus includes an automatic contrast range determining system using a scanning densitometer as described above, then the look-up table should be provided in a memory of the apparatus control means.

Conveniently the carrier is constructed with the photochromic body providing the contrast mask for each original incorporated in it. This may be in the form of a piece of photochromic material at each location on the carrier where an original is to be placed, or the carrier may have a large piece of photochromic material extending over several original receiving positions. Preferably the carrier can be removed from the apparatus altogether, so that loading of it photographic originals and clearing the masks can be carried out separately, and a number of carriers can be used with one such photographic apparatus.

As an example, the exposure head of an HK model 977 photographic printing machine (manufactured by HK Productions Ltd. of Hendon, North London) may be adapted by providing a mask-forming exposure lamp to one side of the exposure head and replacing the original-holding chamber with means to mount a circular carrier which may be rotated to carry originals in front of the mask-forming lamp and the photographic exposure lamp in turn. An automatic contrast range scanning densitometer may also be provided. Such an adapted apparatus can be used to produce photo compositions of high quality with relative ease.

As an alternative to the above, the apparatus may be very simple. In a conventional photographic enlarger the original is usually held in a carier between two piece of glass or similar transparent material, one of which has usually been given "anti-Newton" treatment to avod optical interference effects such as Newton's rings. This carrier may be modified by replacing one of those pieces of glass with a photochromic body and means may be provided to generate the mask-forming exposure. The mask-forming exposure means is conveniently a high power flash lamp as described above, with controls which allow it to be flashed a variable number of times in quick succession. The photographic reproduction apparatus or enlarger used may be entirely conventional. Such an arrangement is suitable for the production of high-quality prints from transparencies and other work of a nature which does not warrant investment in highly sophisticated automated apparatus.

The following general points should be noted in the use of the present invention:

(a) As with any contrast masking system, during the photographic exposure it may be possible for the mask to be between the original and the light source, but during the mask-forming exposure the photochromic body must receive an image of the original in the light falling on it, although as stated above it need not always be adjacent the original.

(b) If an infra-red blocking filter is used, it should be placed between the light source and the photochromic body.

(c) If for some reason a photographic exposure is unsatisfactory, and it needs to be repeated, it may not be necessary to clear the photochromic body and re-form the mask. If the photochromic body and the original are taken as a single unit in another optical density measuring step, the optical density or contrast range found may be used to determine the amount of mask-forming exposure needed to replenish any partial fading of the mask.

BRIEF DESCRIPTION OF DRAWINGS

Apparatus and methods embodying the present invention, given by way of example, will now be described with reference to the accompanying drawings, in which.

MODES FOR CARRYING OUT THE INVENTION AND INDUSTRIAL APPLICABILITY

Figure 1:
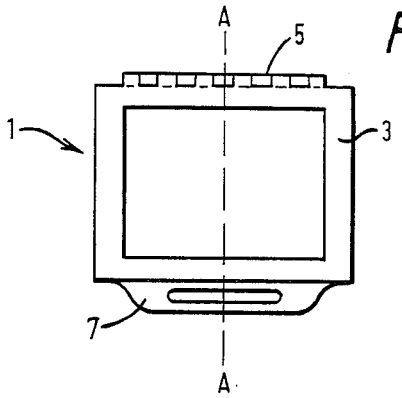
FIG. 1 is a schematic plan view of a holder for a photographic original embodying the present invention, in a closed position.

A holder 1 for a photographic original has a frame 3 comprising two parts 3*a*, 3*b* joined by a hinge 5. The frame is of a rigid supporting material such as a metal. Remote from the hinge 5 there is a handle 7. Securing means (not shown) allow the two parts 3*a*, 3*b* of the frame 3 to be secured to each other when it is closed up. Each frame part 3*a*, 3*b* carries a respective sheet of glass or other transparent material 9, 11. A first transparent sheet 9 may be a sheet of "anti-Newton" glass, and if it is intended to be the sheet nearer to the light source during photographic exposures it may be an infra-red blocking filter, to protect the original and the second sheet 11 from heat from the light source.

The second sheet 11 is a photochromic body which is sensitive, so as to increase its optical density, to the majority of wavelengths in the visible spectrum, preferably to substantially all of them, but substantially none of the wavelengths of the visible spectrum decrease its optical density. When the photochromic sheet 11 has increased its optical density, it has an increased optical density with respect to substantially all wavelengths in the visible spectrum. Preferably it is optically neutral (grey) over a range of optical densities.

Preferably the sheet 11 is a glass or similar material containing one or more silver halides.

The shape and dimensions of the holder 1 are conventional.

Figure 2:
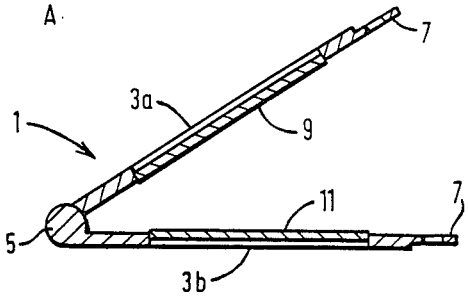
FIG. 2 is a schematic sectional view of the holder of FIG. 1 taken along line A—A, in an open position.

In use, the holder 1 is opened (as in FIG. 2) and a transparent photographic original is placed between the sheets 9, 11. The holder 1 is then closed, and the original held between the sheets 9, 11. Means may be used to secure the original in place. The optical contrast range of the original is determined, either before it is placed in the holder or with it in the holder. The original, in the holder 1, is then illuminated through the sheet 9 with light comprising wavelengths effective to darken the photochromic sheet 11. In this way an optical contrast mask for the original is formed in the sheet 11. The amount of exposure is controlled having regard to the optical density range of the original and the sensitivity of the sheet 11 so as to form a mask of a desired density range. The light is preferably white light containing a large spread of wavelengths.

The holder 1 with the original is then placed in a photographic reproduction apparatus and a photosensitive recording medium is exposed through it. In this way the contrast range of the original may be corrected by contrast masking during the photographic reproduction process in a simple and effective manner.

Figure 3:
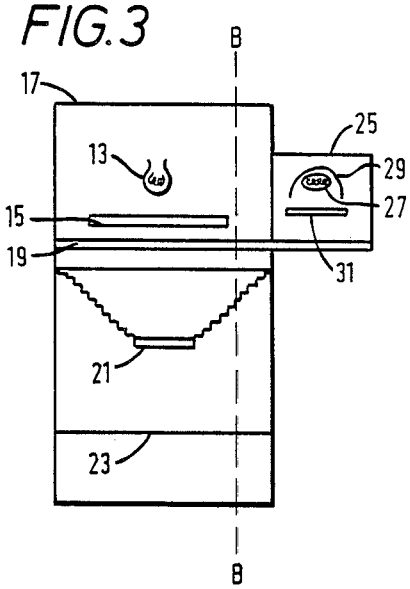
FIG. 3 is a schematic front view of a photographic reproduction apparatus embodying the present invention.

FIG. 3 is a schematic representation of a commercial photographic enlarger, adapted in accordance with the present invention. As with a conventional enlarger, it has a light source 13 and a set of filters 15 contained within a head 17, a space 19 for receiving a transparent photographic original in a holder, a lens 21 and a table 23 for supporting a photosensitive recording medium to be exposed during a photographic reproduction operation and moving it to desired positions for the photographic exposures. A shutter and means for controlling the aperture of the lens are also provided but not shown.

In addition to these conventional features the apparatus has an enclosure 25 mounted to the side of the head and the space 19 is enlarged to extend into this enclosure. The enclosure contains a powerful white light source 27 with a reflector 29 to reflect most of the light emitted by the light source 27 into the space 19 beneath it. Between the light source 27 and the space 19 there is a diffuser 31 to diffuse the light evenly over the area immediately below the source 27. The diffuser 31 could be replaced by a condenser, but it might be less easy to obtain an even distribution of light if this was done.

In use the optical contrast range of a transparent original is measured and the original, mounted in a carrier, is placed beneath the light source 27 in the space 19. Either a photochromic body is mounted in the carrier with the original or, more preferably, the transparent region of the carrier on the side of the original remote from the light source 27 is made of a photochromic body. The white light source 27 is actuated to expose the photochromic body through the original and thus form a contrast mask in the photochromic body. The amount of this exposure is controlled in relation to the measured optical contrast range of the original and the desired optical contrast range of the original with the mask. Conveniently the white light source 27 is an adapted photographic studio flash lamp arranged to flash at a fast rate e.g. 3 flashes per second, for a controllable number of flashes. Preferably it has a colour temperature of 5600K.

Following this mask-forming exposure the carrier is moved in the space 19 to bring the original, now with an associaed contrast mask, into a photographic exposure position beneath the photographic light source 13 and the filters 15. The photographic exposure then takes place in the normal way.

The mask-forming light source 27 is in a separate enclosure from the photographic light source 13 partly to shield each process from the light used in the other, but also to hinder heat from the photographic light source from reaching the position occupied by the original during the mask-forming process. This is to minimise the time for which the photochromic body is exposed to temperatures which might have a detrimental effect on its performance. Similarly, it is preferable for the filters 15 to include a filter which blocks infra-red, to reduce unnecessary heating of that part of the space 19 which lies beneath it.

Preferably the carrier for the transparent original is arranged to carry a plurality of such originals. It may be arranged to carry the originals in a straight line, and be moved in use through the enlarger and out the other side, carrying each original past the mask-forming light source 27 and the photographic light source 13 in turn. In this case the space 19 should be open at each end. However, it is preferred for the carrier to be arranged to carry the originals at locations around a circle, as shown in FIG. 4.

Figure 4:
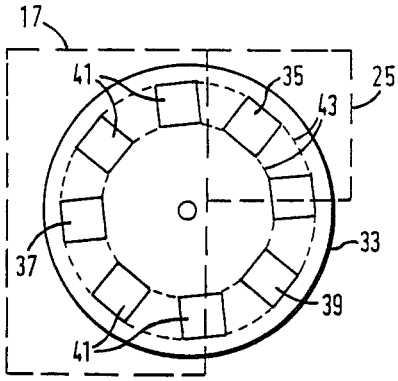
FIG. 4 is a schematic plan view of a holder for a plurality of originals embodying the present invention and for use with the apparatus of FIG. 3.

In FIG. 4 a circular carrier 33 is arranged to hold eight originals at locations spaced around a circle. The number of eight originals is only an example, and carriers could be provided adapted to hold more or fewer originals. The carrier 33 would be mounted in use in the space 19 and would be rotated about an axis shown by the dashed line B—B in FIG. 3. By rotation it would bring an original first to a position 35 beneath the mask-forming light source 27 and then to a position 37 beneath the photographic light source 13.

Preferably the adapted photographic enlarger also has an automatic densitometer. This could work by scanning each original and measuring its optical density at a large number of points. From this it could determine the lightest and darkest part of the original and thus determine its contrast range. The output from the automatic densitometer would be used to control the operation of the mask-forming light source 27, so that a suitable contrast mask is formed automatically. If the originals were to travel through the enlarger in a straight line, then the automatic densitometer should be located on the side of the enclosure 25 for the mask-forming light source 27 remote from the head 17 (i.e. to the right of the enclosure 25 in FIG. 3). If the originals are to be mounted on a circular carrier 33, then the automatic densitometer should be mounted so that by rotation of the carrier 33 about the axis B-B the original may be passed beneath it. Preferably the densitometer is mounted immediately next to the mask-forming light source 27, and scans the original as it moves into position in front of the light source 27. Alternatively the original may be held stationary at a position 39 while it is scanned by the densitometer.

At each location at which an original is to be held around the carrier 33, the carrier has a photochromic body 41 as its portion below the original (i.e. at the side of the carrier away from the light sources 13, 27). These photochromic bodies 41 have the same properties as that forming the sheet 11 of the holder 1 of FIGS. 1 and 2. The optical contrast masks are formed in these photochromic bodies 41. As an alternative, these bodies 41 could be replaced by a single annular photochromic body following the dotted lines 43 in FIG. 4.

Following completion of the photographic exposures, the carrier 33 is removed from the space 19 and the originals are removed from the carrier. The carrier 33 is then warmed to clear the masks from its photochromic bodies 41 and then cooled again to be ready for re-use. If the photochromic bodies contain silver halide as a photochromic substance, as is preferred, then this cooling is preferably done quickly by forced cooling.

One advantage of a carrier which can hold several originals is that it facilitates making a number of related exposures, such as during a photomontage or photo composition. This has particular application in producing originals for printing (either transparent or for viewing with reflected light), as will now be described.

In many areas of printing a number of photographs may be present on a printed page, either separated or overlaid. A mail order catalogue is an example of a publication of this type. In a mail order catalogue, as in some other cases, the quality of the photographic reproduction is very important as the full detail of the articles must be shown, both in the light and in the dark areas of the photographs. This can be very difficult with some articles, such as clothes, lace curtains, carpets, china, cutlery and jewellery, which have fine details. Normally the artwork and a page layout scheme would be sent to a printer, who would perform colour correction and colour separation operations, and prepare printing plates. The printer may also do some contrast correction, and will usually have to enlarge or reduce the constituent photographs by various amounts.

However, it is known to use photocomposition techniques to prepare a print of the completed page by exposing different bits of a photosensitive recording medium in turn with different photographs while masking the rest of the recording medium. The completed print is then presented to a printer who can scan it and prepare printing plates without performing any composition or correction operations. The print is thus used as a reflection original by the printer. In place of a print, a transparent version of the completed page may be made and used in an analogous manner. One difficulty with this method is that the various photographs making up a page will vary in average optical density and in contrast range, and this must all be evened out in the print prepared for the printer if he is to be able to prepare for printing simply by scanning the print. Additionally, the contrast range of the photographs usually must be reduced if all the detail is to be retained. Since each photograph will require its own contrast mask, made in accordance with its contrast range, separate masks are needed for each photograph in the composition. There are often eight to ten photographs in a page, and there may be very many more, for instance 30, or even 60, different photographs in a page of jewellry in a mail-order catalogue. To prepare thse masks by the traditional process is difficult and tedious, and thus this method of printing can be expensive. However, if the transparent originals for all the component photographs are mounted in a carrier with photochromic bodies as described above, the entire composition exposure may be carried out, including forming and using contrast masks, relatively easily, and provided the carrier can hold all the originals at once it need not be removed from the photographic reproduction apparatus (enlarger) during the process. The process is thus speeded up and simplified, providing a faster and cheaper service to the publisher and printer.

Figure 5:
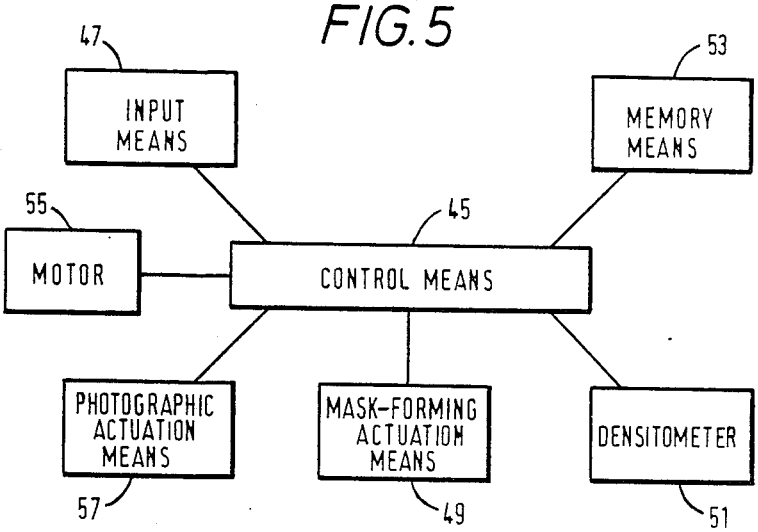
FIG. 5 is a schematic block diagram of a control system for the apparatus of FIG. 3.

FIG. 5 shows an embodiment of a control system for the apparatus of FIG. 3. The system comprises a control means 45, input means 47 to the control means, and actuation means 49 such as a switch or a flash control unit for the mask-forming exposure lamp 27. The input means 47 may take a variety of forms, but its basic function is to enable the operator or outside circumstances to control the operation of the control system. For instance, in a highly automated system it may be a simple "ON/OFF" switch, or a sensor for detecting the presence of an original carrier. Alternatively, it may include means for the operator to enter information concerning the optical contrast range of an original for which a contrast mask is to be formed. In the preferred embodiment the control means 45 comprises a microprocessor and the input means 47 comprises a keyboard input to the microprocessor. The control means 45 controls the operation of the actuation means 49 for the lamp 27 in response to information concerning the optical contrast range of an original, so as to control the amount of mask-forming exposure provided by the lamp 27. For example, the control means 45 may control the number of flashes provided by the lamp 27 or the period for which it operates. This latter option would act in effect as a control of the number of flashes if the actuation means 49 operated to flash the lamp 27 repeatedly during the said period.

Additionally, the control means 45 is connected to an automatic densitometer 51 and a memory means 53, e.g. a ROM, containing a "look-up" table as mentioned previously. The control means 45 can cause the densitometer 51 to measure the density of an original in a plurality of places on the original, preferably by scanning the original as it is moved past the densitometer 51. In this way the control means 45 can obtain information concerning the optical contrast range of the original, and it can then use the memory means 53 to discover the required amount of mask-forming exposure to be provided by the lamp 27. Optionally the automatic densitometer 51 may not be present. In this case the memory means 53 with the "look-up" table may still be present, allowing an operator to enter the (separately measured) optical contrast range through the input means 47. Alternatively the memory means 53 may also not be present, in which case the operator will have to enter the required amount of mask-forming exposure through the input means 47.

Other components which are connected to the control means 45 so as to be controlled by it are a motor 55, and actuating means 57 for the photographic exposure lamp 13. The motor 55 may be operated to move the carrier and thus move the originals from one station to another, such as from the mask-forming exposure station to the photographic exposure station. The actuating means 57 may allow the control means to perform the photographic exposure automatically when the original arrives at the photographic exposure station. Alternatively, the motor 55 may be absent, and the carrier may be moved by hand, or the motor 55 may be present but controlled separately. Similarly the actuating means 57 for the photographic exposure lamp 13 may be controlled separately.

The HK model 977 photographic printing machine, on which the enlarger of FIG. 3 may be based, is computercontrolled, and in the preferred embodiment in the control system of FIG. 5 the control means 45 comprises a computer which controls substantially all the operations of the enlarger.

The operation of the control system of FIG. 5, and in particular of the control means 45, in the preferred embodiment will now be described with reference to the flow chart of FIG. 6.

Prior to making a photographic reproduction, the parameters required will usually be determined in a separate process. This would involve such steps as determining the enlargement required for each original, the exposure required and the position of the recording medium while each original is exposed, the preparation of any obscuring masks for the recording medium (necessary in a photo composition process as described above), the determination of any overall colour correction required by the characteristics of the recording medium to be used, and the like. This information is recorded, either in the memory means 53 or elsewhere. It is convenient for information specific to a particular original to be recorded on a removable machine-readable means such as a magnetic disc or card which may be presented to an appropriate reader, provided as part of the input means 47, by the operator at the time of making the photographic reproduction.

When making the reproduction, the operator would mount the carrier in the space 19, and initialise the control means in step s1. The initialisation would include identifying to the control means 45 which originals are held in the carrier or in providing the control means 45 with the above-mentioned information concerning the originals, and also providing the control means with any other necessary information such as details of the photosensitive recording medium to be used.

Then in step s2 the control means will operate the motor 55 to bring the first original to the photographic exposure station beneath the photographic exposure light source 13. In step s3 it will adjust the head 17, the lens 21 and other parts of the enlarger to bring the original into focused on the table 23 at the correct enlargement, using the data fed to it about this original, as in the HK 977 machine. It will then enter a state s4 in which the operator can cause it to operate various parts of the enlarger in accordance with the input to the input means 47. The actions taken by the operator at this stage may vary, but typically he will set up the photosensitive recording medium on the table 23 while the enlarger shutter is closed, place an obscuring mask over it to protect it from light, cause the control means 45 to open the shutter and take a light reading from the light source 13, alter the exposure details or the colour filtration if desired, close the shutter and move the table 23 to return the photosensitvive recording medium to its "home" position under the photographic exposure light source 13, remove the protective obscuring mask and fit another obscuring mask over the recording medium appropriate for the original concerned (i.e. a mask which obscures all but a predetermined portion of the recording medium).

When the operator is ready for the photographic exposure to take place, he will inform the control means 45 of this through the input means 47. The control means 45 will then move up to step s5 in which it moves the table 23 to bring the recording medium and the obscuring mask to the correct position for exposing this original (in photocomposition it is normal for each original to be located centrally under the light source 13 during the exposure, and for the recording medium to be moved to cause the correct portion of it to be exposed).

In step s6 it operates the motor 55 to move the carrier so as to bring the original to the densitometer 51. In step s7 the motor 55 continues to operate, and the densitometer 51 is operated to scan the original as it passes under it. The densitometer output is fed to the control means 45 which stores temporarily the highest and lowest values obtained. In step s8 the motor is stopped, to halt the original under the mask-forming exposure lamp 27.

The highest and lowest values obtained from the densitometer 51 in step s7 represent the contrast range of the original. The control means 45 now consults the look-up table in the memory means 53, in step s9, to determine the correct mask-forming exposure. Then in step s10 it operates the actuating means 49 for the mask-forming exposure light source 27 to provide the mask-forming exposure. The actuating means 49 is controlled by the control means 45 to provide the correct amount of exposure, in accordance with the highest and lowest values of densitometer output and the look-up table.

Following the mask-forming exposure step s10, the control means operates the motor 55 again to return the original to the photographic exposure station below the photographic exposure lamp 13 in step s11. It will then operate the shutter to provide the photographic exposure in the normal way, in step s12.

Following the photographic exposure the control means operates the motor 55 again, in step s13, to bring the next original into position beneath the photographic exposure light source 13. It then returns to step s3.

This process continues until it is stopped by the operator.

The steps may be varied, and the order in which they are performed may be varied. For instance, if the mask-forming exposure in step s10 sheds light outside the enlarger, it will be necessary for the operator to be enabled to place an obscuring mask on the whole of the photosensitive recording medium before this step, and replace it with the mask appropriate for the photographic exposure of the original afterwards.

Figure 7:
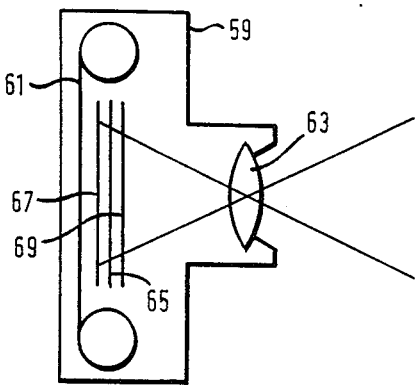
FIG. 7 is a schematic view of another photographic reproduction apparatus embodying the present invention.

In FIG. 7 a photographic camera is shown as an example of a photographic reproduction apparatus having a photochromic body at an image plane. The camera 59 supports a photosensitive film 61, onto which an image may be focussed by a lens 63. Immediately in front of the film 61 is a photochromic body 65. The image falling onto the film 61 thus falls onto the photochromic body 65, which may act as a contrast mask. Preferably the camera has two shutters 67, 69, one 67 between the film 61 and the photochromic body 65 and the other 69 in front of the body 65. In order to form the contrast mask, only the front shutter 69 is opened, exposing the photochromic body 65 so as to form a contrast mask but protecting the film 61. When the photograph is taken both shutters 67, 69 are opened, exposing the film 61 through the mask formed in the photochromic body 65.

Figure 6:
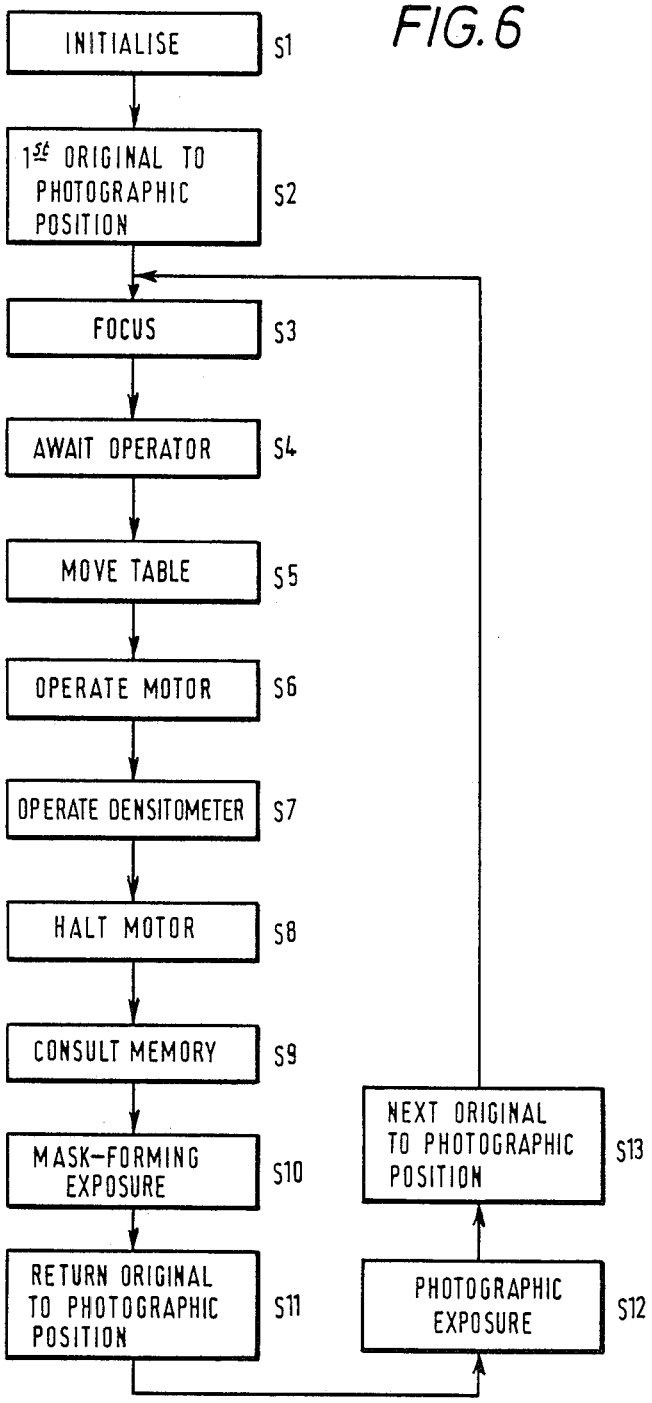
FIG. 6 is a flow chart showing the operation of the control system of FIG. 5 in a photographic reproduction process.

It should be noted that the film 61, the body 65 and the shutters 67,69 are shown with exaggerated spacing in FIG. 6. it should also be noted that this location for a photochromic body, where an image of the original is focussed, is not limited to cameras but may be used in other photographic reproduction apparatus.

I claim:

1. A method of preparing photographic reproductions, in which respective portions of a photosensitive recording medium are successively exposed to respective transparent photographic originals in a succession of respective photographic reproduction processes during which the remaining said portions of the recording medium are protected from exposure, each said photographic reproduction process including contrast masking by a method in which a photochromic body (11,41) is illuminated by an image of the original.

2. A method of photographic reproduction of an original comprising the steps of:

(a) forming a contrast mask by exposing a photochromic body to mask-forming electromagnetic radiation bearing an image of the original; and (b) thereafter recording an image of said original on a photographic recording medium by exposing said photographic recording medium to recording electromagnetic radiation with which the original is illuminated and which has passed through said contrast mask; wherein the wavelengths of said mask-forming radiation used to form the contrast mask in step (a) comprise visible wavelengths present in said recording electromagnetic radiation in step (b) and used to affect the recording medium in step (b);

the photochromic body is sensitive, so as to increase its optical density, to the majority of wavelengths in the visible spectrum, but substantially insensitive to wavelengths in the visible spectrum so as to decrease its optical density;

the photochromic body when its optical density has been increased by exposure to said mask-forming electromagnetic radiation, in step (a), has an increased optical density with respect to substantially all wavelengths in the visible spectrum to provide a substantially neutral contrast mask; and said photochromic body is substantially less sensitive to electromagnetic radiation than said photographic recording medium, and said recording step includes the step of supplying said recording electromagnetic radiation in an amount sufficient to record said image but insufficient to substantially affect said photochromic body.

3. A method according to claim 2, in which the photochromic body (11,41), when it increases in optical density due to exposure to electromagnetic radiation, increases in optical density to the same amount with respect to all wavelengths in the visible spectrum.

4. A method according to claim 3, in which the photochromic body (11,41) is an optically neutral grey.

5. A method according to claim 2, in which the photochromic body (11,41) contains one or more silver halides as a photochromically active substance.

6. A method according to claim 2, in which the mask-forming exposure and the photographic exposure take place at different locations.

7. A method according to claim 6, in which the ambient temperature around the photochromic body (11,41) throughout the said process up until it is moved to the location of the photographic exposure is no greater than 20° C. and subsequent to the photographic exposure the contrast mask is cleared from the photochromic body (11,41) in a process during which the photochromic body is heated to at least 25° C.

8. A method according to claim 2, in which said mask-forming electromagnetic radiation includes multi-wavelength white light of a colour temperature of at least 4000K.

9. A method according to any one of claims 2 or 3–8 inclusive in which said mask-forming electromagnetic radiation is provided as a plurality of flashes produced by a photographic flashlamp.

10. A method according to claim 9, in which the said flashes are provided by a white light source (27) which delivers at least 300 J of electromagnetic radiation per flash.

11. A method according to claim 9, in which the said flashes are provided at a rate of at least one per two seconds.

12. A method according to claim 2 in which the original is transparent and the photochromic body is exposed through the original.

13. A method according to claim 8 wherein said original is colored and said step of recording an image includes the step of recording a colored image.

14. A method of preparing photographic reproductions, in which respective portions of a photosensitive recording medium are successively exposed to respective transparent photographic originals in a succession of respective photographic reproduction processes during which the remaining said portions of the recording medium are protected from exposure each said photographic reproduction process including the steps of:

(a) forming a contrast mask by exposing a photochromic body (11,41) to mask-forming electromagnetic radiation bearing an image of the original; and (b) recording an image of said original on a photographic recording medium by exposing said photographic recording medium to recording electromagnetic radiation with which the original is illuminated and which has passed through said contrast mask; wherein the wavelengths of said mask-forming radiation used to form the contrast mask in step (a) comprise wavelengths present in said recording electromagnetic radiation in step (b) and used to affect the recording medium in step (b);

the photochromic body (11,41) is sensitive, so as to increase its optical density, to the majority of wavelengths in the visible spectrum, but substantially insensitive to wavelengths in the visible spectrum so as to decrease its optical density; and the photochromic body (11,41), when its optical density has been increased by exposure to electromagnetic radiation in step (a), has an increased optical density with respect to substantially all wavelengths in the visible spectrum.

15. A method according to claim 14, in which the reproduction is not transparent but is viewable by reflected light.

16. A method according to claim 14, in which the reproduction is suitable for use as an original for printing.

17. A method according to claim 14 wherein, in each said photographic reproduction process, said photochromic body is substantially less sensitive to electromagnetic radiation light than said photographic recording medium, and said recording step includes the step of supplying said recording electromagnetic radiation in an amount sufficient to record said image but insufficient to substantially affect said photochromic body.

* * * * *

UNITED STATES PATENT AND TRADEMARK OFFICE

CERTIFICATE OF CORRECTION

PATENT NO. : 4,758,502

DATED : July 19, 1988

INVENTOR(S) : Paul Banks

It is certified that error appears in the above-identified patent and that said Letters Patent is hereby corrected as shown below:

Column 2, line 10, "use" should read --dye--.
Column 3, line 2, "matachromic" should read --metachromic--.
Column 4, line 24, "decease" should read --decrease--.
Column 5, line 59, "photochomism" should read --photochromism--.
Column 9, line 12, after "in" insert --advance, which gives the amount of mask-forming--.
Column 9, line 53, "piece" should read --pieces--.
Column 12, line 6, "associaed" should read --associated--.
Column 13, line 61, "thse" should read --these--.
Column 15, line 43, "focused" should read --focus--.

Signed and Sealed this

Fourteenth Day of March, 1989

*Attest:*

DONALD J. QUIGG

*Attesting Officer*

*Commissioner of Patents and Trademarks*